United States Patent [19]

Stockman

[11] 4,121,654

[45] Oct. 24, 1978

[54] DRY COOLING TOWER

[75] Inventor: Richard Franklin Stockman, Friendship, N.Y.

[73] Assignee: The Air Preheater Company, Inc., Wellsville, N.Y.

[21] Appl. No.: 819,914

[22] Filed: Jul. 28, 1977

[51] Int. Cl.[2] ..... F28D 19/00

[52] U.S. Cl. ..... 165/6; 165/7; 165/DIG. 1

[58] Field of Search ..... 165/6, 7, DIG. 1

[56] References Cited

U.S. PATENT DOCUMENTS

| | | | |
|---|---|---|---|
| 1,741,726 | 12/1929 | Murray | 165/7 X |
| 3,007,685 | 11/1961 | Hryniszak | 165/7 X |
| 3,804,155 | 4/1974 | Glicksman | 165/6 X |
| 3,834,450 | 9/1974 | Penny | 165/10 X |

*Primary Examiner*—Albert W. Davis, Jr.
*Attorney, Agent, or Firm*—Wayne H. Lang

[57] ABSTRACT

A gas-liquid heat exchange device that utilizes a plurality of heat absorbent discs mounted on a horizontal axis and adapted to be rotated between a liquid and a gas stream to transfer heat from the liquid to the gas. The discs are imparted a rotational force by driving means that utilizes the gravitational force attracting the heavier liquid.

11 Claims, 3 Drawing Figures

DRY COOLING TOWER

BACKGROUND OF THE INVENTION

Power generation, manufacturing, air conditioning, and various other processes require significant amounts of thermal dissipation in order that effective operation may proceed. Recent ordinances forbid the discharge of excess heat into most waterways so large water-cooled heat exchangers are not permitted, or are at least looked upon with much disfavor. Furthermore, common evaporative heat exchangers consume excessive amounts of water and they precipitate appreciable amounts of moisture into the air, thus causing extensive ground fog over neighboring areas, so they too are generally classified as undesirable.

An alternate to water-cooled heat exchangers and to evaporative cooling towers comprises what is known as dry cooling towers. Dry cooling towers discharge heat therefrom directly into the air so they have a lower effectiveness and they are relatively expensive, but they do not discharge heat into adjacent bodies of water, nor do they discharge moisture into the atmosphere, so they have obvious environmental advantages in spite of their lower effectiveness and greater expense.

The present invention is therefore directed to a dry cooling tower that transfers heat from a liquid to a gas with few disadvantages of either system and most of the advantages of both.

Description of the Prior Art

A dry cooling tower of the type generally defined has been developed in accordance with U.S. Pat. No. 3,804,155 to transfer heat from one fluid to another without loss of evaporative fluid. In this patent a multiple disced rotor rotates between water and air. Heat absorbed from the water is carried by an array of rotating discs into the air where the cooler air absorbs the heat carried by the discs. To prevent the water from adhering to the rotating discs and being carried into the cooling air, a coating of oil is floated on the surface of the water so that oil coats the surface of the discs thereby preventing water from adhering thereto and being evaporated into the ambient air.

The rotating discs are generally driven by a system of drive chains and sprockets connected to a motor that is provided with a continuous source of power. Inasmuch as an independent drive mechanism is usually required for each one of many rotatable units, an installation is inherently complicated, it requires extensive maintenance, and it is expensive to install.

SUMMARY OF THE INVENTION

The present invention accordingly relates to a "dry" regenerative cooling tower having a plurality of discs or heat absorptive plates that are rotated continuously between a liquid and a gas to transfer heat from one fluid to the other. More particularly, the principal objective of this invention is to provide driving means for the heat absorptive plates that utilizes the gravitational force attracting the heavier liquid as the power for motivation.

BRIEF DESCRIPTION OF THE DRAWING

The invention is further defined with reference to the accompanying drawing in which.

DESCRIPTION OF THE PREFERRED EMBODIMENT

Figure 1:
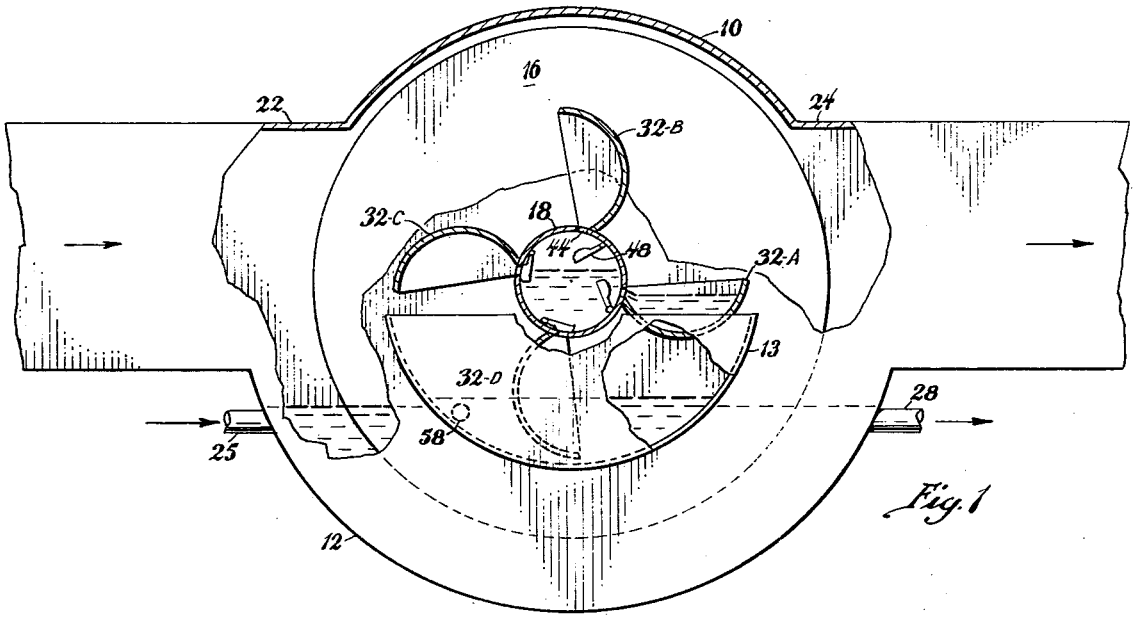
FIG. 1 is a side elevation of a rotary disc cooling tower.
Figure 2:
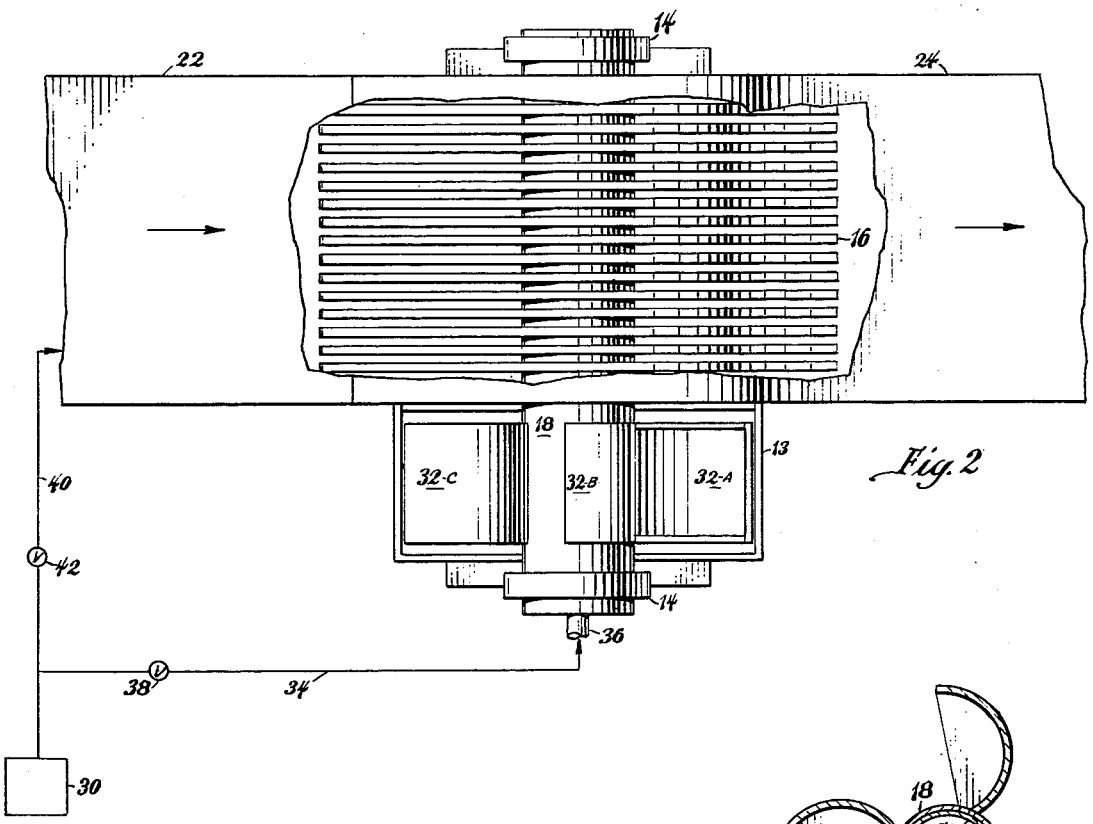
FIG. 2 is a top view of the device of FIG. 1.

The heat exchanger of this invention comprises a housing that includes an arcuate cover 10 and a lower basin 12 having an extension 13 at one side thereof with side walls that support bearings 14 for a horizontally disposed shaft 18 therebetween. A rotor of spaced discs 16 is supported on the shaft such that the lower parts of discs are disposed in the lower basin 12 containing a hot liquid such as water while the uppermost portions of the rotor discs 16 are simultaneously contacted by a cool fluid such as air. The air enters the cover through an inlet 22 and exhausts through an outlet 24. As the discs are slowly rotated about their horizontal axes, they are continuously moved between the hot and cool fluids so that heat from the hot liquid is continuously being transferred to the cooler gas exhausting through outlet 24.

The hot liquid supplied to the lower basin 12 through inlet 25 and exhausting through outlet 28 is sufficient to raise the level of liquid contained therein below the axis of the horizontally disposed shaft whereby a lower minor segment of each disc is immersed in hot liquid while an upper major segment of each disc is being contacted by the cooler air as it passes from inlet 22 to outlet 24.

Usually the entire amount of hot liquid to be cooled is supplied to basin 12 through the direct inlet 26 and exhausted through the outlet 28 after a predetermined level of the liquid in basin 12 has been attained. An independent source of motive power utilizing complex drive chains, sprockets, and the like is then required to rotatively drive the horizontally disposed shaft 18 and its concentric discs whereby heat absorbed from the hot liquid may be transferred to the cooler air.

The device of this invention utilizes the gravitational force upon the hot liquid flowing to the lower basin 12 as the sole driving force necessary to rotate the discs 16 between the hot liquid and the cool air.

Accordingly, a basin 13 of lesser diameter than the basin 12 is connected to one side of basin 12 with an outer wall thereof adapted to support a bearing 14 whereby the shaft 18 may be laterally extended to pass horizontally across basins 12 and 13 between bearings 14. The portion of the shaft 18 lying in basin 12 supports the rotating discs 16, while the portion of shaft 18 that lies in basin 26 is adapted to support the driving means for the entire shaft 18.

The driving means for the horizontal shaft comprises essentially a series of radial vanes 32 on shaft 18 lying in basin 13 that are subject to the rotational force provided by the gravitational attraction on the liquid to be cooled as it passes over the vanes.

The liquid to be cooled is supplied from a source 30 to a supply line 34 and secondary inlet 36. Flow through line 34 is regulated by control of valve 38, while flow through line 40 is regulated by control of valve 42. Thus by means of opening and closing valves 38 and 42, the rate of flow through inlet 36 may be regulated to provide a predetermined force to the driving means.

The driving means on shaft 18 comprises a series of radial cup-shaped vanes 32 that form a water wheel driven by the liquid to be cooled. As the liquid enters inlet 36, it flows into the interior of shaft 18 and out through radial ports 44 in the tubular wall of shaft 18 where it fills upright vane 32-A creating an unbalance of force that tends to rotate the rotor in a clockwise direction. Due to the tilted disposition of vanes represented by 32-B, 32-C, or 32-D, none may hold liquid so the unbalance continuously is at one side of shaft 18 by the gravitational effect upon the liquid in vane 32-A. As vane 32-A moves downwardly, it is replaced by the vane 32-B, which being in an upright position may receive and hold liquid to provide an unbalance of forces that will rotate the shaft. This process is continued as long as a source of liquid is supplied through inlet 36.

Although the cup-shaped vanes 32 will hold liquid therein only when they are disposed in an upright position, the ports 34 may remain continuously open so that liquid is free to flow therethrough at all times, thereby requiring excess fluid to maintain a minimum rotative force. To reduce the amount of liquid required for rotation of the discs, a system of valves 48 may be incorporated therewith to close all ports except the one adjacent an upright vane (as represented by vane 32-A), whereby all liquid exhausted from tubular shaft 18 will be instrumental in creating an unbalance of force thereby having a rotational effect upon the shaft.

Figure 3:
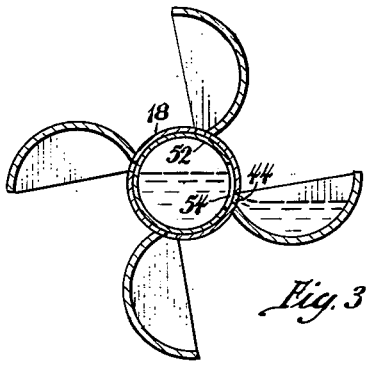
FIG. 3 shows an alternative valving arrangement.

While valving means 48 has been shown schematically as comprising simple check valves, it could also assume other configurations represented by FIG. 3. Here the tubular shaft 18 rotates with respect to a fixed tube 52, when port 54 of shaft 52 coincides with port 30 of shaft 18, radial flow will occur, and the vane adjacent thereto will fill with liquid.

After the liquid has progressively filled the vanes 32 and caused them to rotate about their axes, the liquid is dumped into basin 13, and then discharged through opening 58 or an equivalent passageway into basin 12 where any residual heat therein is absorbed by the discs 16 before being transferred to the air flowing over the vanes.

It is apparent that other flow patterns may be substituted for those suggested herein without amounting to invention, and it is intended that all material shown in the accompanying drawing or described in the accompanying specification shall be interpreted as illustrative and not in a limiting sense.

I claim:

1. A cooling tower for the transfer of heat between a hot liquid and a cool gas including a housing having inlet and outlet ports for the hot liquid, gas inlet and outlet ports in the housing spaced above the ports for the hot liquid, bearing means supported by said housing that defines an axis of rotation lying above the surface of the liquid, a horizontal tubular shaft mounted on said bearing means, a series of disc members axially apertured to receive the horizontal shaft and thus rotate between the liquid and the gas, and drive means connected to said horizontal shaft rotated by the force of gravity acting upon the hot liquid as it passes from the inlet to the outlet of the housing.

2. A cooling tower as defined in claim 1 wherein the drive means comprises a water wheel that is mounted for rotation upon the horizontal rotor shaft.

3. A cooling tower as defined in claim 1 wherein the horizontal shaft comprises an elongate tube that permits the flow of fluid therethrough.

4. A cooling tower as defined in claim 1 wherein the water wheel is laterally displaced on said shaft at one side of the rotatable discs.

5. A cooling tower as defined in claim 1 wherein the water wheel comprises a series of similarly disposed cupped members arcuately spaced around the periphery of the horizontal shaft and adapted to hold a quantity of heated liquid therein when they are disposed at one side of said shaft.

6. A cooling tower as defined in claim 1 wherein an inlet passageway for the hot liquid traverses an elongate passageway in the horizontal rotor shaft.

7. A cooling tower as defined in claim 6 having radially disposed apertures that extend between the elongate passageway in the horizontal rotor shaft and the water wheel to supply hot liquid thereto.

8. A cooling tower as defined in claim 7 wherein the water wheel comprises a series of similarly disposed cup members arcuately spaced around the periphery of the rotor shaft.

9. A cooling tower as defined in claim 1 wherein the horizontal shaft comprises a tubular member that encloses a central passageway having an inlet for the hot liquid at one end thereof and radial apertures that traverse the tubular shaft to provide hot liquid to the cup-shaped water wheel.

10. A cooling tower as defined in claim 9 having a check valve in each aperture that controls liquid flowing therethrough.

11. A cooling tower as defined in claim 1 wherein the horizontal shaft rotates about a fixed supply tube lying concentrically within said shaft, and radial apertures in the horizontal shaft and in the supply tube adapted to coincide when an adjacent cup-shaped vane is moved into an upright position.

* * * * *